US009970169B2

(12) United States Patent
Pickup et al.

(10) Patent No.: US 9,970,169 B2
(45) Date of Patent: May 15, 2018

(54) FLOOD DEFENSE BARRIER

(71) Applicant: HESCO BASTION LTD., Leeds, Yorkshire (GB)

(72) Inventors: Mike Pickup, Leeds (GB); Kenny Scott, Leeds (GB)

(73) Assignee: HESCO BASTION LTD., Yorkshire (GB)

( * ) Notice: Subject to any disclaimer, the term of this patent is extended or adjusted under 35 U.S.C. 154(b) by 0 days. days.

(21) Appl. No.: 14/912,851

(22) PCT Filed: Aug. 29, 2014

(86) PCT No.: PCT/GB2014/052634
§ 371 (c)(1),
(2) Date: Feb. 18, 2016

(87) PCT Pub. No.: WO2015/028821
PCT Pub. Date: Mar. 5, 2015

(65) Prior Publication Data

US 2016/0194844 A1 Jul. 7, 2016

(30) Foreign Application Priority Data

Aug. 29, 2013 (GB) ..... 1315403.4
Jun. 9, 2014 (GB) ..... 1410213.1

(51) Int. Cl.
*E02B 3/10* (2006.01)
*E02B 3/12* (2006.01)
(Continued)

(52) U.S. Cl.
CPC ..... *E02B 3/108* (2013.01); *B65D 88/1625* (2013.01); *E02B 3/12* (2013.01);
(Continued)

(58) Field of Classification Search
CPC ..... E02B 3/108
See application file for complete search history.

(56) References Cited

U.S. PATENT DOCUMENTS 5,685,450 A * 11/1997 Uda ..... B65D 88/1625 220/23.9
6,012,872 A 1/2000 Perry et al.
(Continued)

FOREIGN PATENT DOCUMENTS

DE 295 08 777 U1 9/1996
DE 103 01 204 A1 3/2004
(Continued)

OTHER PUBLICATIONS

Examination Report under Section 18(3), Application No. GB 1410213.1 dated Sep. 30, 2014.
(Continued)

*Primary Examiner* — Tara Mayo-Pinnock
(74) *Attorney, Agent, or Firm* — Ping Wang; Morris, Manning & Martin, LLP

(57) ABSTRACT

The present invention provides a flood defense barrier comprising a first plurality of individual compartments connected by a first, non-releasable fastening means, wherein the plurality of individual compartments comprises at least one second, releasable, fastening means effective for releasably fastening the first plurality of individual compartments to a second plurality of individual compartments. Also provided is a flood defense barrier comprising a first plurality of individual compartments connected together and provided with a continuous length of water impermeable material extending across the individual compartments along at least one side of the barrier, a second plurality of individual compartments connected together and provided with a continuous length of water impermeable material extending across the individual compartments along at least
(Continued)

Figure 1:
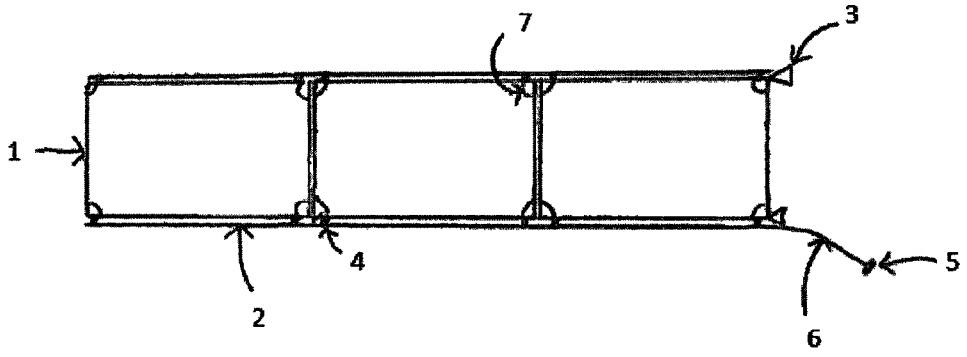

one side of the barrier, and fastening means for fastening the first plurality of individual compartments to the second plurality of individual compartments, as well as methods of deploying said flood defense barrier and uses thereof.

21 Claims, 4 Drawing Sheets

(51) Int. Cl.
*E02D 17/18* (2006.01)
*E02D 29/02* (2006.01)
*B65D 88/16* (2006.01)

(52) U.S. Cl.
CPC ..... *E02D 17/18* (2013.01); *E02D 29/025* (2013.01); *E02D 29/0266* (2013.01); *E02D 29/0291* (2013.01)

(56) References Cited

U.S. PATENT DOCUMENTS

| | | | |
|---|---|---|---|
| 6,312,192 | B1 | 11/2001 | Dery |
| 7,431,534 | B2 | 10/2008 | Harbeck |
| 8,721,221 | B2 | 5/2014 | Cavenagh et al. |
| 2007/0140598 | A1 | 6/2007 | McGillick, Sr. et al. |
| 2011/0305511 | A1 | 12/2011 | Heselden |
| 2012/0207406 | A1 | 8/2012 | Cavenagh et al. |
| 2013/0094905 | A1 | 4/2013 | Schnaars, Sr. et al. |

FOREIGN PATENT DOCUMENTS

| | | | |
|---|---|---|---|
| EP | 0 816 572 | A2 | 1/1998 |
| EP | 1 731 678 | A1 | 12/2006 |
| GB | 2432611 | B | 2/2010 |
| GB | 2493007 | A | 1/2013 |
| GB | 2502152 | A | 11/2013 |
| GB | 2503739 | A | 1/2014 |
| WO | 2004/081290 | A1 | 9/2004 |
| WO | 2005/080691 | A1 | 9/2005 |
| WO | 2009/109735 | A1 | 9/2009 |
| WO | 2010/029349 | A3 | 3/2010 |
| WO | 2012/107745 | A1 | 8/2012 |

OTHER PUBLICATIONS

Combined Search and Examination Report under Sections 17 & 18(3), Application No. GB 1315403.4 dated Jan. 31, 2014.
International Search Report and Written Opinion of the International Searching Authority of International Application No. PCT/GB2014/052634 dated Nov. 5, 2014.

* cited by examiner

FLOOD DEFENSE BARRIER

The present invention relates to flood defense barriers, particularly those which can be deployed quickly and easily and can be removed from the deployment site without leaving behind contaminated fill material.

Flooding is a growing problem in many parts of the world. It is commonly dealt with by erecting barriers to keep rising water levels out of certain areas. Such barriers generally have to be erected quickly and easily, especially as weather conditions are often adverse just before flooding occurs. Additionally, there is often little or no prior warning of flooding and so it would be beneficial to be able to use materials readily available at the site at which the barriers are to be deployed.

Commonly used flood barriers comprise bags filled with soil or sand, which are then wrapped in a water impermeable material such as polyethylene. This process can be time consuming and cannot be guaranteed to result in a strong, fully water impermeable barrier. It is common for small gaps to occur in between the bags, especially at their base. Water can then pass through these gaps, resulting in leakage. The amount of water passing through the barrier depends on the force of the flood, though it can be significant. The force of the water can also create a channel in the ground underneath the barrier, thereby increasing the amount of water that can pass through the barrier.

Once the flooding has subsided, disposal of the material that was used to fill the bags also becomes problematic. The fill material is generally contaminated with materials such as sewage that are present in the floodwater, which seeps into the bag during the flooding. Unfortunately, it is common practice to remove the barriers by simply cutting open the bags and removing the contaminated fill material, which is generally left at the site. This practice has both environmental and safety consequences for the surrounding area.

EP1731678 discloses a flood barrier comprising a plurality of individual compartments. These compartments are attached by screws, nails, clamps or the like, which extend between adjacent side walls of adjacent individual compartments. A plurality of individual compartments can be connected to form a unit and two units can be attached together in the same manner as the individual compartments within each unit are connected, i.e. using screws, nails, clamps or the like.

Whilst this offers some improvements, there is still a need for a flood barrier that is quick and easy to erect, with improved leakage resistance and that allows removal of the contaminated fill material from the site.

The present invention provides a flood defense barrier comprising:

a. a first plurality of individual compartments connected together and provided with a continuous length of water impermeable material extending across the individual compartments along at least one side of the barrier;

b. a second plurality of individual compartments connected together and provided with a continuous length of water impermeable material extending across the individual compartments along at least one side of the barrier; and c. fastening means for fastening the first plurality of individual compartments to the second plurality of individual compartments.

The fastening means may comprise any suitable fastening means, such as eyelets made of, for example, plastic or metal on each plurality of individual compartments, which are then connected by means such as a cable tie. The cable ties may be made of, for example, metal or plastic and may be releasable or non-releasable. Alternatively, other means such as a water impermeable zip (for example the MaxiGrip MX 20), Velcro™ or C-rings (C-shaped metal staples that are then deformed into a circle, thereby connecting the two compartments) can be used. Any number of such fastening means may be used at each join to connect two individual compartments together.

The individual compartments in each plurality may also be connected via fastening means such as those described above. Again, any number of such fastening means may be used at each join to connect two individual compartments together. When eyelets and cable ties, or C-rings, are used, there are preferably four fastening means evenly spaced along each joint between the two individual compartments. In other words, there are four fastening means at the front of the barrier between each individual compartment and four fastening means at the back of the barrier between each individual compartment.

The present invention also provides a flood defense barrier comprising a first plurality of individual compartments connected by a first, non-releasable fastening means, wherein the plurality of individual compartments comprises at least one second, releasable, fastening means effective for releasably fastening the first plurality of individual compartments to a second plurality of individual compartments.

By releasable, it is meant that the fastening means can be unfastened without destruction of the means, such that the means can be re-fastened after said unfastening. In contrast, non-releasable fastening means can only be unfastened either by destruction of the means or their removal from the barrier, so that they cannot subsequently be re-fastened. In one embodiment, the first, non-releasable fastening means comprises a continuous length of material, which may be water impermeable.

Used herein, reference to a "fastening means" refers to the fastening means for fastening the first plurality of individual compartments to the second plurality of individual compartments. Preferably, the fastening means may be provided on at least one of the compartments of a plurality of individual compartments. The at least one compartment provided with a fastening means may be an end compartment. Additionally or alternatively, the complementary fastening means of a second plurality of individual compartments may be on an end compartment. Preferably the fastening means can be fastened and optionally also unfastened without the need for additional equipment.

The individual compartments of the present invention are self-contained units, which are connected by a non-releasable fastening means, which may be a continuous length of water impermeable material extending across the individual compartments along at least one side of the barrier. Preferably, the individual compartments are bags. Each individual compartment preferably comprises side walls and a base. Preferably, the individual compartments are designed to tessellate and so may, for example, be cuboid. At least part of each individual compartment may comprise a water impermeable material. The term "side walls adjacent to another individual compartment" used herein refers to adjacent side walls of adjacent individual compartments that face one another.

Some or all of the individual compartments can contain a fill material. Preferably, all of the individual compartments contain a fill material. The fill material may be selected from sand, earth, soil, stones, rocks, rubble, concrete, debris and combinations of two or more thereof. This fill material provides stability to the barrier and is preferably a material found naturally around the deployment site.

A means for preventing a fill material from falling between adjacent individual compartments may be present. This is particularly important when the fill material is being introduced to the compartments, especially when the fill material is a fine material such as sand. This means may comprise a material extending between the compartments and fastened to the inside of each of the side walls adjacent to the other individual compartment. The material may be fastened by, for example, staples or stitches. Optionally, the means may be attached to the inside of one of the side was adjacent to the other individual compartment and can subsequently be attached to the other side wall.

The flood defense barrier is preferably self-supporting. The flood defense barrier is therefore capable of standing erect before the fill material is inserted. In order to achieve this, some or all of the individual compartments may be made of a stiff fabric. Additionally or alternatively, some or all of the individual compartments may be made of polypropylene. Further, some or all of the individual compartments may comprise a stiffening material to provide or enhance rigidity. The stiffening material may be present on all sides of the individual compartment. The stiffening material may be any suitable material and may comprise one or more of a geogrid, wood and/or polypropylene. By geogrid, it is meant a material that is conventionally used for grass or soil reinforcement. Preferably, CORREX® is used to provide or enhance rigidity.

This stiffening material can be inserted as one or more panels. The panels may be placed against the inside of a side wall of an individual compartment, or may be inserted into a pocket formed within a side wall of an individual compartment. The pocket can then be closed, sealing in the panel. Two adjacent panels may be used on each of two opposite side walls, such that the side walls can fold at a point along their length. This allows the barrier to concertina when not filled. Additionally or alternatively, the side walls adjacent to another individual compartment may comprise one panel, while the side walls perpendicular thereto may comprise two panels, such that the perpendicular side walls can fold to allow the barrier to be compressed. The panels may not extend along the entire length of the side wall, which allows the walls to fold and thereby allows the barrier to be compressed.

Alternatively, the material can be rolled into a cylinder and placed within a compartment, such that it expands to the width of the compartment but maintains a cylindrical shape.

Some or all of the individual compartments may comprise an openable base. This allows the fill material to be easily released from the individual compartments once the barrier is dismantled. Preferably, the base remains closed until such an openable feature is used, so that the compartments, including the fill material, can be removed from the site of deployment. The fill material can then be released as and when is appropriate. However, the base is preferably flat and/or smooth, so as to minimise potential passages for water underneath the plurality of individual compartments. Any suitable means may be used to allow the openable base to open. In one arrangement, the openable base may comprise an opening which is held closed by a toggle mechanism or the like that can be released to allow the opening to open.

Further, some or all of the individual compartments may comprise a lifting means. Such a lifting means may comprise handles on the top edges of the individual compartments. The lifting means helps the individual compartments to be removed from the flood barrier once the flood has subsided.

The plurality of individual compartments may comprise any number of individual compartments. Preferably, the number is between 2 and 15, more preferably between 5 and 12 and even more preferably, 10.

The plurality of individual compartments may be arranged side-by-side, so as to form a line of individual compartments that is one compartment deep. In this linear embodiment, the plurality of individual compartments has two long sides, which extend along the length of all of the individual compartments and two short sides, which are equal to the depth of a single compartment. In this embodiment, a continuous length of water impermeable material may extend along at least one of the long sides. The fastening means for fastening the plurality of individual compartments to a second plurality of individual compartments is preferably at one or both ends of the long side and may be placed on the long side and/or on the short side.

The flood defense barrier is preferably water impermeable along the entirety of one of its sides. This means that the point at which a first plurality of individual compartments is fastened to a second plurality of individual compartments is water impermeable. In the linear embodiment discussed above, this side is preferably one of the long sides. The opposite side of the plurality of individual compartments to the water impermeable side is preferably water permeable. This means that the floodwater will be stopped by the barrier, but that any water that does leak into the individual compartments can then escape. In a further embodiment, the water impermeable side is differently coloured to the opposite side. This allows easy identification of the direction in which the barrier should face, as well as making it obvious that one of the plurality of individual compartments in a barrier comprising multiple pluralities has been placed the incorrect way round. Additionally or alternatively, the fastening means for fastening the first plurality of individual compartments to the second plurality of individual compartments may be arranged such that it is not possible to attach two pluralities of individual compartments in the wrong configuration.

The first, non-releasable fastening means may comprise screws, nails, clamps and the like. Alternatively, the first, non-releasable fastening means may comprise a water impermeable material extending along a side of the plurality of individual compartments, which may be connected to at least some of the individual compartments by stitches, staples or the like. This side may be an external side of the plurality of individual compartments and may also be a side perpendicular to a side of an individual compartment which is adjacent to another individual compartment. In the linear embodiment discussed above, this side is preferably one of the long sides. In one embodiment, a second length of material extends along a side opposite that along which the water impermeable material extends. This second material may be water permeable. The water impermeable material may be used to connect all of the individual compartments in the plurality. The water impermeable material preferably extends along a side of every individual compartment in the plurality.

The water impermeable material may extend beyond the side of the plurality of individual compartments such that it can cover the fastening means for fastening the first plurality of individual compartments to the second plurality of individual compartments. In one embodiment, the material comprises the fastening means to attach the first plurality of individual compartments to a second plurality of individual compartments. Preferably, the material may extend underneath the or each plurality of individual compartments. This reduces the leakage through the barrier, by reducing the formation of channels in the ground caused by the water and thereby reducing the passage of floodwater underneath the barrier. It may therefore be preferable to include a separate section of material on the water impermeable side of the plurality of individual compartments that extends underneath the barrier.

The fastening means for fastening the first plurality of individual compartments to the second plurality of individual compartments may comprise screws, nails, clamps and the like. The fastening means for fastening the first plurality of individual compartments to the second plurality of individual compartments may also or alternatively comprise means that can be unfastened without destruction of the means, such that the means can be re-fastened after said unfastening. In one embodiment, the fastening means for fastening the first plurality of individual compartments to the second plurality of individual compartments may be one or more of a zip, buckles or other arrangements. The fastening means for fastening the first plurality of individual compartments to the second plurality of individual compartments may be water impermeable. A plurality of buckles may be used and preferably, two or three buckles are used. Such fastening means are generally expensive and so incorporating these fastening means once every plurality of individual compartments reduces cost compared to barriers in which a fastening means is included between each individual compartment. The fastening means is preferably covered by a section of material, which is preferably water impermeable and acts to further reduce leakage through the barrier. This section of material may or may not comprise the water impermeable material, as discussed above. The same or different fastening means may be used at each point where the fastening means is present.

Preferably, both buckles and a zip are used. The buckles may be attached to each end of two pluralities of individual compartments and may take a majority of the stress of holding the two pluralities together, which would make it easier to close the zip. The zip may be attached to a section of material covering the buckles and provides improved water impermeability as well as an additional fastening means. The section of material may or may not comprise the water impermeable material of one or both of the pluralities of individual compartments.

When the fastening means is present on the water impermeable material, the fastening means itself preferably acts to create a water impermeable seal. For example, water impermeable zips such as the MaxiGrip MX 20 can be used.

The fastening means for fastening the first plurality of individual compartments to the second plurality of individual compartments may be provided only on one side of the plurality of individual compartments. Alternatively, the fastening means for fastening the first plurality of individual compartments to the second plurality of individual compartments are provided on opposite sides of the plurality of individual compartments. In the linear embodiment discussed above, the water impermeable material may extend along one or both of the long sides. The fastening means for fastening the first plurality of individual compartments to the second plurality of individual compartments may be present on one or both of the short sides, or on the long side close to one or both of the short sides. Additionally or alternatively, the fastening means for fastening the first plurality of individual compartments to the second plurality of individual compartments may be present on one or both of the long sides, or on the short side close to one or both of the long sides.

Additionally, there may also be fastening means (releasable or otherwise) as described above between adjacent individual compartments within the or each plurality of individual compartments. This may provide increased strength and stability to the barrier and such fastening means may also be used to pull the compartments together before they are filled, and/or while (in the case of a releasable fastening) making it easier to remove the individual compartments separately from the plurality of individual compartments when disassembling the flood defense barrier. For example in some embodiments of the invention releasable fastening means, such as buckles or zips, may be provided between individual compartments in the or each plurality of individual compartments. Conveniently, such fastening means may be provided on the compartments on the opposite side of the barrier from the continuous sheet of water impermeable material.

To further reduce leakage, the flood defense barrier of the present invention may further comprise a compressible member extending at least part of the distance from the top to the bottom of at least one side of the plurality of individual compartments. Additionally or alternatively, the flood defense barrier may comprise a compressible member extending at least part of the distance along the base of at least one side of the plurality of individual compartments. In the linear embodiment discussed above, the compressible member is preferably on one or both of the short sides of the plurality of individual compartments.

Said compressible member may comprise foam and may further comprise a hollow foam tube. Preferably, the compressible member is resiliently compressible. In a further embodiment, a compressible member extending at least part of a distance along one side of a plurality of individual compartments is offset from a compressible member extending at least part of a corresponding distance along an adjacent side of a second plurality of individual compartments when the two are attached by a fastening means for fastening the first plurality of individual compartments to the second plurality of individual compartments.

The compressible member is preferably compressed against a surface adjacent the side of the plurality of individual compartments (which may be another plurality of individual compartments) as the individual compartment on which it is placed is filled with a fill material. This acts to further decrease leakage as the compressible member forms a water impermeable seal. Preferably, leakage is reduced by around 10%.

The flood defense barrier according to the present invention may comprise any number of pluralities of individual compartments. Preferably, there are more than two pluralities of individual compartments. This provides a barrier of adjustable length, depending on the requirements of the deployment site Also provided is a method for deploying a flood defense barrier according to the present invention, comprising transporting the folded plurality of individual compartments to a deployment site, unfolding the plurality of individual compartments and filling each individual compartment with a fill material, before or after which the plurality of individual compartments is attached to another group of one or more individual compartments by the fastening means for fastening the first plurality of individual compartments to the second plurality of individual compartments. In an embodiment, an individual compartment at the end of the flood defense barrier is filled with a fill material and tension is subsequently applied to the opposite end of the flood defense barrier so as to unfold and erect the plurality of individual compartments. Alternatively, the pluralities of individual compartments may be provided at the deployment site erected and optionally also filled.

When the flood defense barrier of the present invention is to be removed, the fastening means for fastening the first plurality of individual compartments to the second plurality of individual compartments may be released, so as to separate the pluralities of individual compartments. In an embodiment, the water impermeable material is destroyed so as to separate the individual compartments. Each individual compartment may then be removed and taken away from the site separately. The fill material in each individual compartment may be released at the site, or may be released once the individual compartment has been taken away from the site.

Also provided is the use of a flood defense barrier according to the present invention as a barrier against elemental forces, such as flooding.

Any of the above embodiments of the present invention may further comprise a lid extending at least partially over the top of one or more of the individual compartments. This lid prevents the fill material from accidentally being removed from the compartment, for example by water or wind. Removal of the fill material would mean that the barrier becomes lighter and so can be more easily displaced.

Preferably, the lid extends over the entirety of the top of the individual compartment. The lid may be fastened to the individual compartment using any suitable means. The lid itself may comprise any suitable material. In one embodiment, the lid is at least partially formed by the water impermeable material extending from the side of the barrier at least partially over the top of the barrier. In this embodiment, at least a portion of the impermeable material may be taller than the one or more individual compartments along which it extends, so that it can reach over the top of one or more of the compartments, thereby creating a lid.

The barrier may also include a reflective material, which increases the visibility of the barrier in the dark. Preferably, this reflective material is on the rear of the barrier, on the opposite side to the water impermeable material. The reflective material may be at any suitable position, such as on the lifting means, the lid or the individual compartments themselves.

Figure 2:
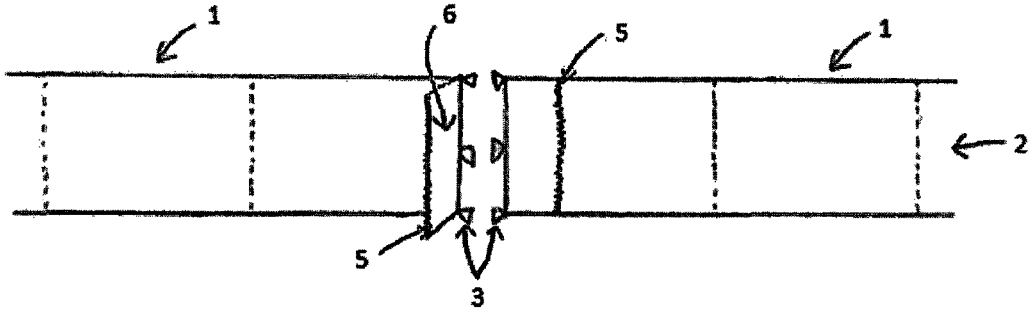
Figure 3:
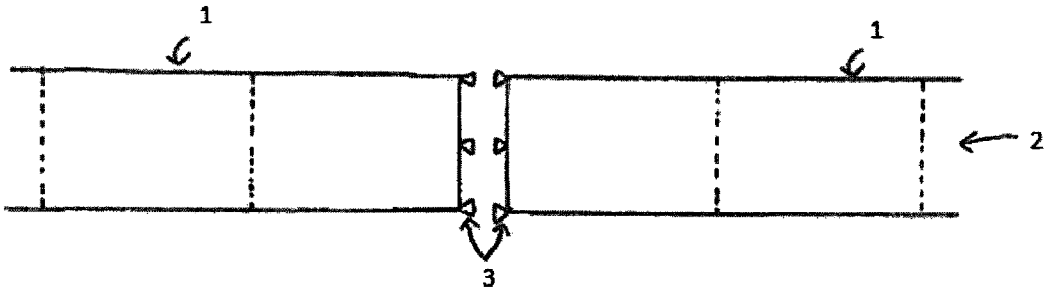
Figure 4:
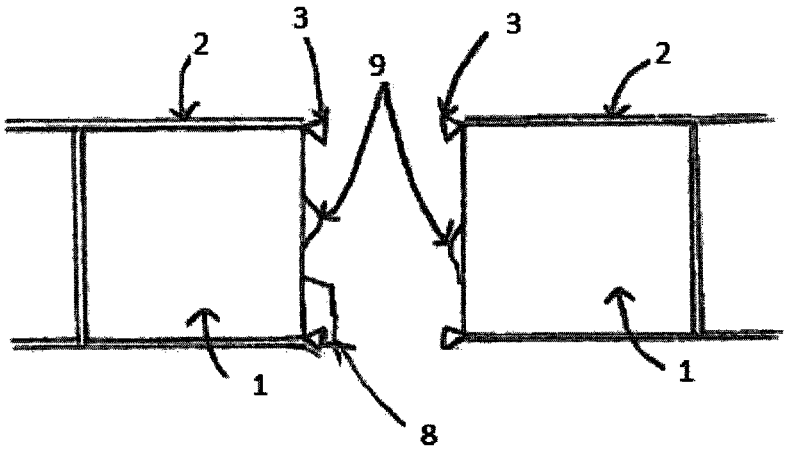
Figure 5:
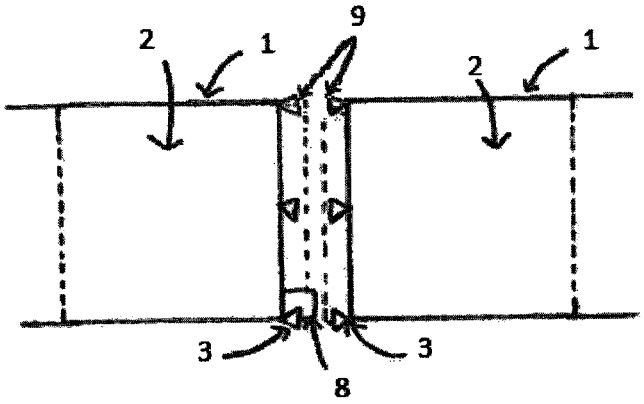
Figure 6:
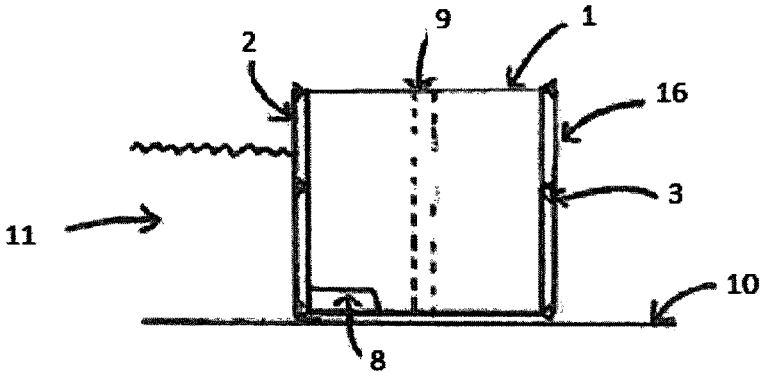
Figure 7:
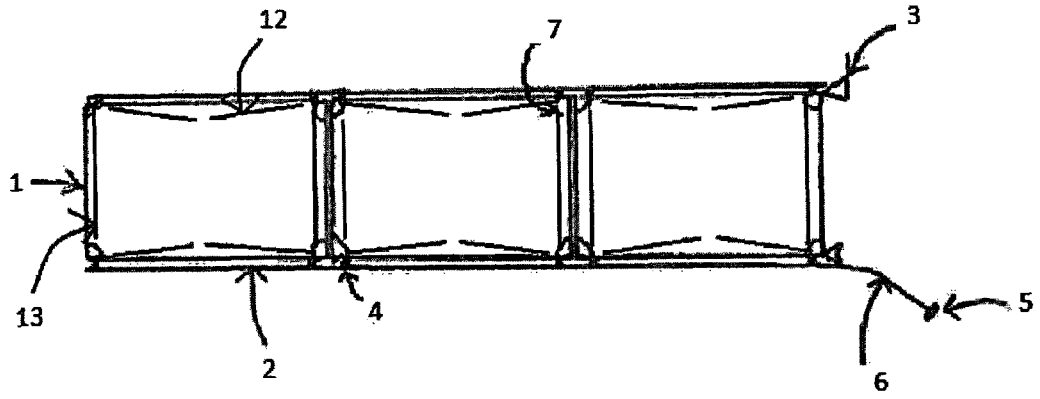
Figure 8:
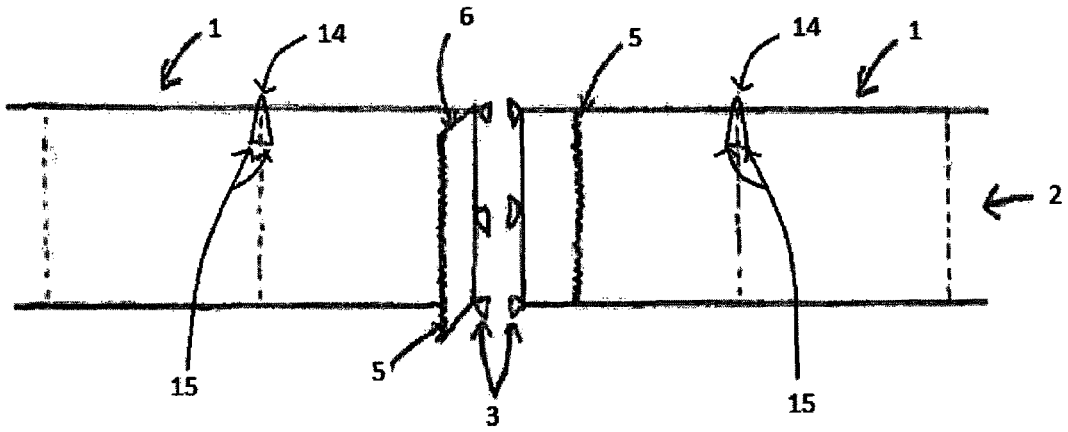
Figure 9:
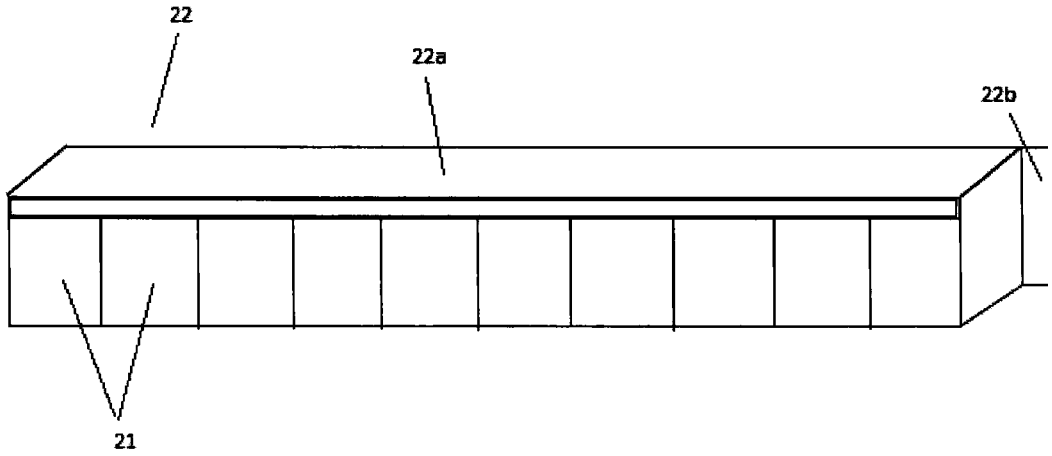
Figure 10:
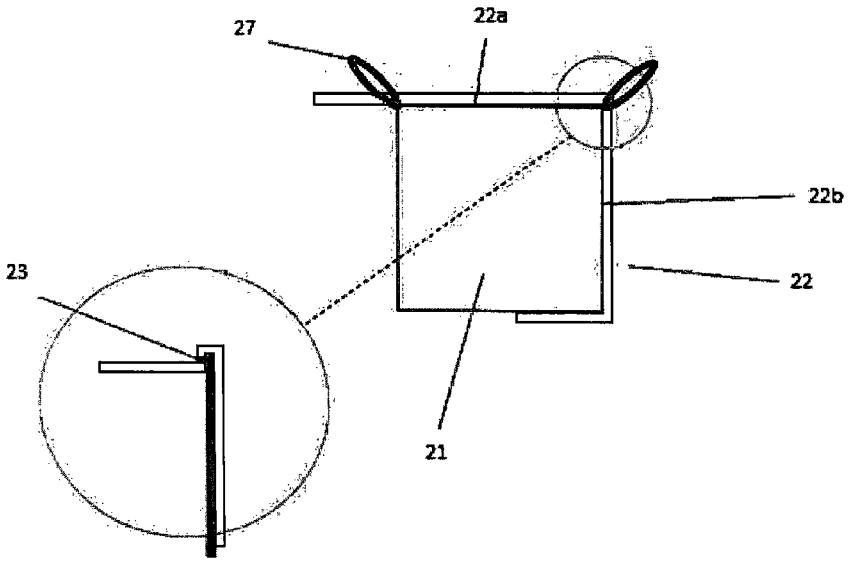

One or more embodiments of the invention are described further hereinafter, by way of example only, with reference to the accompanying drawings in which:

FIG. 1 demonstrates the top view of a plurality of individual compartments;

FIG. 2 demonstrates the front view of the plurality of individual compartments as shown in FIG. 1, adjacent to a second plurality of individual compartments;

FIG. 3 demonstrates the back view of the plurality of individual compartments as shown in FIG. 1, adjacent to a second plurality of individual compartments;

FIG. 4 demonstrates the top view of a plurality of individual compartments adjacent to another plurality of individual compartments and further comprising compressible members;

FIG. 5 demonstrates the side view of a plurality of individual compartments adjacent to another plurality of individual compartments and further comprising compressible members;

FIG. 6 shows the flood barrier of the present invention when deployed against floodwater;

FIG. 7 demonstrates the plurality of individual compartments shown in FIG. 1, further comprising stiffening means;

FIG. 8 demonstrates the front view of the plurality of individual compartments shown in FIG. 2, further comprising means for preventing a fill material from falling between adjacent individual compartments;

FIG. 9 demonstrates a rear view of a further embodiment of the present invention, comprising a lid extending over the top of the individual compartments; and FIG. 10 demonstrates a side view of one of the individual compartments shown in FIG. 9.

Looking at the drawings in more detail, FIG. 1 demonstrates the top view of a plurality of individual compartments 1, connected by a continuous length of water impermeable material 2. In this embodiment, the water impermeable material 2 comprises stitches 4 to attach the material to the individual compartments 1. Fastening means 3 are present on the end compartment of the plurality of individual compartments 1, in the form of buckles. An additional fastening means is shown as a zip 5 on the end of a section of material 6, which is an extension of the water impermeable material 2. Also illustrated are lifting means 7, in the form of handles at each corner of the individual compartments 1.

FIG. 2 demonstrates the front view of the plurality of individual compartments 1 as shown in FIG. 1, adjacent to a second plurality of individual compartments 1. The individual compartments 1 in each plurality are connected by a water impermeable material 2. The fastening means 3 (in this case comprising three buckles) are present on both end compartments of each plurality of individual compartments 1. The section of material 6 will extend over the fastening means 3 and will be attached to the adjacent plurality of individual compartments 1 using the zip 5, thereby reducing leakage of floodwater between the pluralities of individual compartments 1.

FIG. 3 demonstrates the back view of the plurality of individual compartments 1 as shown in FIG. 1, adjacent to a second plurality of individual compartments 1. The individual compartments 1 in each plurality are connected by a water impermeable material 2. The fastening means 3 (in this case comprising three buckles) are present on both end compartments of each plurality of individual compartments 1.

FIG. 4 demonstrates the top view of a plurality of individual compartments 1 adjacent to another plurality of individual compartments 1, each of which are connected by a water impermeable material 2. Both individual compartments 1 comprise a fastening means 3. Each individual compartment 1 further comprises a compressible member 9 extending the distance from the top to the bottom of the side of the individual compartment 1. In this embodiment, the two compressible members 9 are offset from one another. One of the individual compartments 1 further comprises a compressible member 8 extending part of the distance along the base of the individual compartment 1.

FIG. 5 demonstrates the side view of the plurality of individual compartments 1 as demonstrated in FIG. 4. Again, this figure shows a plurality of individual compartments 1 adjacent to another plurality of individual compartments 1, each of which are connected by a water impermeable material 2. Both individual compartments 1 comprise a fastening means 3. Each individual compartment 1 further comprises a compressible member 9 extending the distance from the top to the bottom of the side of the individual compartment 1. One of the individual compartments 1 further comprises a compressible member 8 extending part of the distance along the base of the individual compartment 1.

FIG. 6 shows the flood barrier of the present invention when deployed against floodwater 11. The individual compartment 1 is placed on the ground 10, with the water impermeable material 2 facing the floodwater 11. An opposite length of material 16 extends along the side opposite the water impermeable material and is preferably water permeable. In this embodiment, a section of the water impermeable material 2 extends underneath the individual compartment 1 to further reduce leakages. The two compressible members 8, 9 are also illustrated.

FIG. 7 demonstrates the plurality of individual compartments 1 shown in FIG. 1, further comprising stiffening means 12, 13. Stiffening means 13 extend along the side walls of the individual compartments adjacent to another individual compartment and comprise a single panel placed against the inside of the side wall. Stiffening means 12 extend along the side walls perpendicular to the side walls adjacent to another individual compartment. Two stiffening means 12 are placed adjacent one another to extend along the full length of the inside of the side wall. This allows the perpendicular side wall to fold in the middle, allowing the plurality of individual compartments 1 to collapse.

FIG. 8 demonstrates the front view of the plurality of individual compartments 1 shown in FIG. 2, further comprising a means for preventing a fill material from falling between adjacent individual compartments 14. The means 14 comprises a material extending between adjacent individual compartments 1 and fastened to the inside of each of the adjacent side walls. The means 14 is fastened by fastening means 15, which may comprise stitches or staples.

FIG. 9 demonstrates a rear view of a plurality of individual compartments 21 according to a further aspect of the present invention, which comprises a lid 22 extending over the top of each of the individual compartments 21. Lid 22 comprises a top portion 22*a* and a front portion 22*b* that extends along the front side of the individual compartments 21. The front portion 22*b* is a water impermeable material comprising polythene that extends along the front side of the individual compartments 21. The lid 22 then reaches over the top of the individual compartments 21 to form the top portion 22*a*, so that the front portion 22*b* and the top portion 22*a* are continuous. It is this top portion 22*a* that prevents the fill material from accidentally being removed from the individual compartment 21. The edge of the top portion 22*a* furthest away from the front portion 22*b* is then attached to the individual compartments 21 by Velcro.

FIG. 10 demonstrates a side view of one of the plurality of individual compartments 21 shown in FIG. 9. Front portion 22*b* of the lid 22 is shown extending along the height of the individual compartment 21 and underneath it. This provides a means for anchoring the lid material, as well as providing a waterproof front to the individual compartment 21. Front portion 22*b* also extends over the top of the individual compartment 21 to form the top portion 22*a* of the lid 22. Also shown are lifting means 27 in the form of handles at either side of the individual compartment 21.

FIG. 10 also demonstrates an enlarged view of the top corner of the individual compartment 21, in which the material of the lid 22 extends over the top of the individual compartment 21 and is stapled to the inside thereof using staples 23.

The invention claimed is:

1. A flood defense barrier comprising:

a) a first plurality of individual compartments non-releasably connected together and provided with a continuous length of water impermeable material connected to at least some of the individual compartments and extending across the individual compartments along at least one side of the barrier;

b) a second plurality of individual compartments non-releasably connected together and provided with a continuous length of water impermeable material connected to at least some of the individual compartments and extending across the individual compartments along at least one side of the barrier; and c) releasable fastening means for fastening the first plurality of individual compartments to the second plurality of individual compartments, wherein the water impermeable material on the first plurality of individual compartments extends beyond the side of the first plurality of individual compartments such that it can cover the releasable fastening means.

2. A flood defense barrier comprising a first plurality of individual compartments connected by a first, non-releasable fastening means which comprises a water impermeable material extending along a side of the first plurality of individual compartments and which is connected to at least some of the individual compartments, wherein the plurality of individual compartments comprises at least one second, releasable, fastening means effective for releasably fastening the first plurality of individual compartments to a second plurality of individual compartments, and wherein the water impermeable material extends beyond the side of the first plurality of individual compartments such that it can cover the releasable fastening means.

3. The flood defense barrier according to claim 2, wherein the fastening means for fastening the first plurality of individual compartments to the second plurality of individual compartments is provided on an end compartment of the plurality of individual compartments, optionally wherein the complementary fastening means of a second plurality of individual compartments is on an end compartment; and/or wherein the individual compartments are bags; and/or wherein each individual compartment comprises side walls and a base; and/or wherein some or all of the individual compartments contain a fill material, optionally wherein the fill material is selected from sand, earth, soil, stones, rocks, rubble, concrete, debris and combinations of two or more thereof; and/or further comprising a means for preventing a fill material from falling between adjacent individual compartments, optionally wherein the means for preventing a fill material from falling between adjacent individual compartments comprises a material extending between the compartments and fastened to the inside of each of the side walls adjacent to the other individual compartment; and/or wherein the flood defense barrier is self-supporting; and/or wherein some or all of the individual compartments are made of a stiff fabric; and/or wherein some or all of the individual compartments are made of polypropylene.

4. The flood defense barrier according to claim 2, wherein some or all of the individual compartments comprise a stiffening material to provide or enhance rigidity; and/or further comprising panels of stiffening material, optionally wherein the panels are inserted into a pocket formed within a side wall of an individual compartment and/or optionally wherein two adjacent panels are used on each of two opposite side walls of an individual compartment.

5. The flood defense barrier according to claim 4, wherein a stiffening means is present on all sides of the individual compartment.

6. The flood defense barrier according to claim 2, wherein some or all of the individual compartments comprise an openable base; and/or comprising more than two pluralities of individual compartments; and/or wherein some or all of the individual compartments comprise a lifting means; and/or wherein the plurality of individual compartments consists of 10 individual compartments; and/or wherein the flood defense barrier is water impermeable along the entirety of one of its sides, optionally wherein the opposite side of the plurality of individual compartments to the water impermeable side is water permeable; and/or wherein the water impermeable side is differently colored to the side opposite said water impermeable side.

7. The flood defense barrier according to claim 2, wherein a water impermeable material extends along an external side of a plurality of individual compartments, optionally wherein the external side is a side perpendicular to a side of an individual compartment which is adjacent to another individual compartment; and/or wherein the material extends along a side of every individual compartment in the plurality.

8. The flood defense barrier according to claim 1, wherein the fastening means for fastening the first plurality of individual compartments to the second plurality of individual compartments is provided on an end compartment of the plurality of individual compartments, optionally wherein the complementary fastening means of a second plurality of individual compartments is on an end compartment; and/or wherein the individual compartments are bags; and/or wherein each individual compartment comprises side walls and a base; and/or wherein some or all of the individual compartments contain a fill material, optionally wherein the fill material is selected from sand, earth, soil, stones, rocks, rubble, concrete, debris and combinations of two or more thereof; and/or further comprising a means for preventing a fill material from falling between adjacent individual compartments, optionally wherein the means for preventing a fill material from falling between adjacent individual compartments comprises a material extending between the compartments and fastened to the inside of each of the side walls adjacent to the other individual compartment; and/or wherein the flood defense barrier is self-supporting; and/or wherein some or all of the individual compartments are made of a stiff fabric; and/or wherein some or all of the individual compartments are made of polypropylene.

9. The flood defense barrier according to claim 1, wherein some or all of the individual compartments comprise a stiffening material to provide or enhance rigidity; and/or further comprising panels of stiffening material, optionally wherein the panels are inserted into a pocket formed within a side wall of an individual compartment and/or optionally wherein two adjacent panels are used on each of two opposite side walls of an individual compartment.

10. The flood defense barrier according to claim 9, wherein a stiffening means is present on all sides of the individual compartment.

11. The flood defense barrier according to claim 1, wherein some or all of the individual compartments comprise an openable base; and/or comprising more than two pluralities of individual compartments; and/or wherein some or all of the individual compartments comprise a lifting means; and/or wherein the plurality of individual compartments consists of 10 individual compartments; and/or wherein the flood defense barrier is water impermeable along the entirety of one of its sides, optionally wherein the opposite side of the plurality of individual compartments to the water impermeable side is water permeable; and/or wherein the water impermeable side is differently colored to the side opposite said water impermeable side.

12. The flood defense barrier according to claim 1, wherein a water impermeable material extends along an external side of a plurality of individual compartments, optionally wherein the external side is a side perpendicular to a side of an individual compartment which is adjacent to another individual compartment; and/or wherein the material extends along a side of every individual compartment in the plurality.

13. The flood defense barrier according to claim 12, wherein the material comprises the fastening means for fastening the plurality of individual compartments to a second plurality of individual compartments.

14. The flood defense barrier according to claim 12, wherein the material extends underneath the plurality of individual compartments.

15. The flood defense barrier according to claim 1, wherein the fastening means for fastening the first plurality of individual compartments to the second plurality of individual compartments comprises a zip and/or buckles; and/or wherein the fastening means for fastening the first plurality of individual compartments to the second plurality of individual compartments are provided only on one side of the plurality of individual compartments or wherein the fastening means for fastening the first plurality of individual compartments to the second plurality of individual compartments are provided on opposite sides of the plurality of individual compartments.

16. The flood defense barrier according to claim 1, comprising fastening means between adjacent individual compartments within the or each plurality of individual compartments, optionally wherein the fastening means between adjacent individual compartments within the or each plurality of individual compartments are releasable fastening means, such as buckles or zips; and/or wherein the fastening means is provided on the compartments on the opposite side of the barrier from the continuous sheet of water impermeable material.

17. The flood defense barrier according to claim 1, further comprising a compressible member extending at least part of the distance from the top to the bottom of at least one side of the plurality of individual compartments; and/or further comprising a compressible member extending at least part of the distance along the base of at least one side of the plurality of individual compartments;

optionally wherein the compressible member comprises foam; and/or wherein the compressible member is resiliently compressible; and/or wherein a compressible member extending at least part of the distance along one side of a plurality of individual compartments is offset from a compressible member extending at least part of the distance along an adjacent side of another group of one or more individual compartments when the two are attached by a fastening means for fastening the first plurality of individual compartments to the second plurality of individual compartments.

18. The flood defense barrier according to claim 1, further comprising a lid extending at least partially over the top of at least one of the individual compartments, optionally wherein the lid is at least partially formed by the water impermeable material extending from the side of the barrier at least partially over the top of the barrier.

19. A method for deploying a flood defense barrier according to claim 1, comprising:

transporting the folded plurality of individual compartments to a deployment site;

unfolding the plurality of individual compartments; and filling some or all of the individual compartments with a fill material, before or after which the plurality of individual compartments is attached to another group of one or more individual compartments by the fastening means for fastening the first plurality of individual compartments to the second plurality of individual compartments, optionally wherein an individual compartment at the end of the flood defense barrier is filled with a fill material and tension is subsequently applied to the opposite end of the flood defense barrier so as to unfold and erect the plurality of individual compartments.

20. A method for deploying a barrier, comprising:

transporting the flood defense barrier of claim 1 to a deployment site in folded form;

unfolding the plurality of individual compartments; and filling some or all of the individual compartments with a fill material.

21. The flood defense barrier according to claim 1, wherein the individual compartments in each of the first and second pluralities are connected by a non-releasable continuous length of water impermeable material, and wherein the non-releasable continuous length of water impermeable material connects at least some of the individual compartments in each of the first and second pluralities.

* * * * *